US006123584A

United States Patent [19]

Van Koetsem et al.

[11] Patent Number: 6,123,584

[45] Date of Patent: Sep. 26, 2000

[54] CONNECTOR

[75] Inventors: Jan Peter Karel Van Koetsem, Zwijndrecht; Gert Droesbeke, Nijlen; Luc Van den Torren, Bonheiden; Luc Jonckheere, Dilbeek, all of Belgium

[73] Assignee: Framatome Connectors Int'l, Courbevoie, France

[21] Appl. No.: 09/339,505

[22] Filed: Jun. 24, 1999

[30] Foreign Application Priority Data

Jun. 30, 1998 [NL] Netherlands ..... 1009530

[51] Int. Cl.[7] ..... H01R 23/06

[52] U.S. Cl. ..... 439/608; 439/108

[58] Field of Search ..... 439/607–610, 439/101, 108

[56] References Cited

U.S. PATENT DOCUMENTS

| | | | |
|---|---|---|---|
| 3,774,142 | 11/1973 | Siegler | 339/14 R |
| 4,020,430 | 4/1977 | Heyden | 439/608 |
| 4,265,506 | 5/1981 | Hollyday | 439/608 |
| 4,647,122 | 3/1987 | Kelly | 439/608 |
| 4,659,163 | 4/1987 | Althouse et al. | 439/608 |
| 4,940,429 | 7/1990 | Chambers et al. | 439/608 |
| 5,633,617 | 5/1997 | Tsujiguchi et al. | 439/608 |
| 5,647,768 | 7/1997 | Messuri et al. | 439/620 |

FOREIGN PATENT DOCUMENTS

| | | |
|---|---|---|
| 0693795 A1 | 1/1996 | European Pat. Off. . |
| 0809331 A1 | 11/1997 | European Pat. Off. . |
| 2693845 | 1/1994 | France . |

*Primary Examiner*—Hien Vu
*Attorney, Agent, or Firm*—Perman & Green, LLP

[57] ABSTRACT

A connector for high frequency signals comprises a housing of insulating material and a plurality of male contact elements. The housing has a bottom and two opposite side walls extending upwardly from the bottom, the bottom and side walls determining a receiving space. The bottom is provided with cavities regularly arranged in rows and columns. Each of the contact elements is mounted in a cavity, an upper end of each contact element projecting into the receiving space. At least a plurality of the cavities are metallized at their the inner walls. The contact elements are mounted in the metallized cavities by means of a support element of insulating material. Each support has a lower extension directed away from the receiving space and each support element is metallized at its outer side.

9 Claims, 3 Drawing Sheets

CONNECTOR

BACKGROUND OF THE INVENTION

1. Field of the Invention

The invention relates to a connector for high frequency signals, comprising a housing of insulating material and a plurality of male contact elements, said housing having a bottom and two opposite side walls extending upwardly from the bottom, the bottom and side walls determining a receiving space, wherein the bottom is provided with cavities regularly arranged in rows and columns, wherein each of the contact elements is mounted in a cavity, an upper end of each contact element projecting into the receiving space.

2. Description of the Related Art

In a connector of the above-mentioned type it is known to use a number of the male contact elements as ground contact elements as a shielding for the signal contact elements. In this manner the number of contact elements which can be used as signal contact elements significantly decreases so that the signal density of the connector is relatively low.

The invention aims to provide a connector of the above-mentioned type with improved shielding and increased signal density, which connector can be adapted to different applications in an easy manner.

BRIEF SUMMARY OF THE INVENTION

To this end the connector of the invention is characterized in that at least a plurality of the cavities are metallized at their the inner walls, wherein the contact elements are mounted in the metallized cavities by means of a support element of insulating material, wherein each support element has a lower extension directed away from the receiving space, each support element being metallized at its outer side.

In this manner a connector is obtained, wherein all contact elements mounted in metallized cavities can be used as signal contact elements thereby increasing the signal density significantly. Further, the connector can be adapted to different applications by combining the housing with contact elements having a support element made in accordance with a given application.

The invention will be further explained by reference to the drawings in which an embodiment of the connector of the invention is schematically shown.

DETAILED DESCRIPTION OF THE INVENTION

Figure 1:
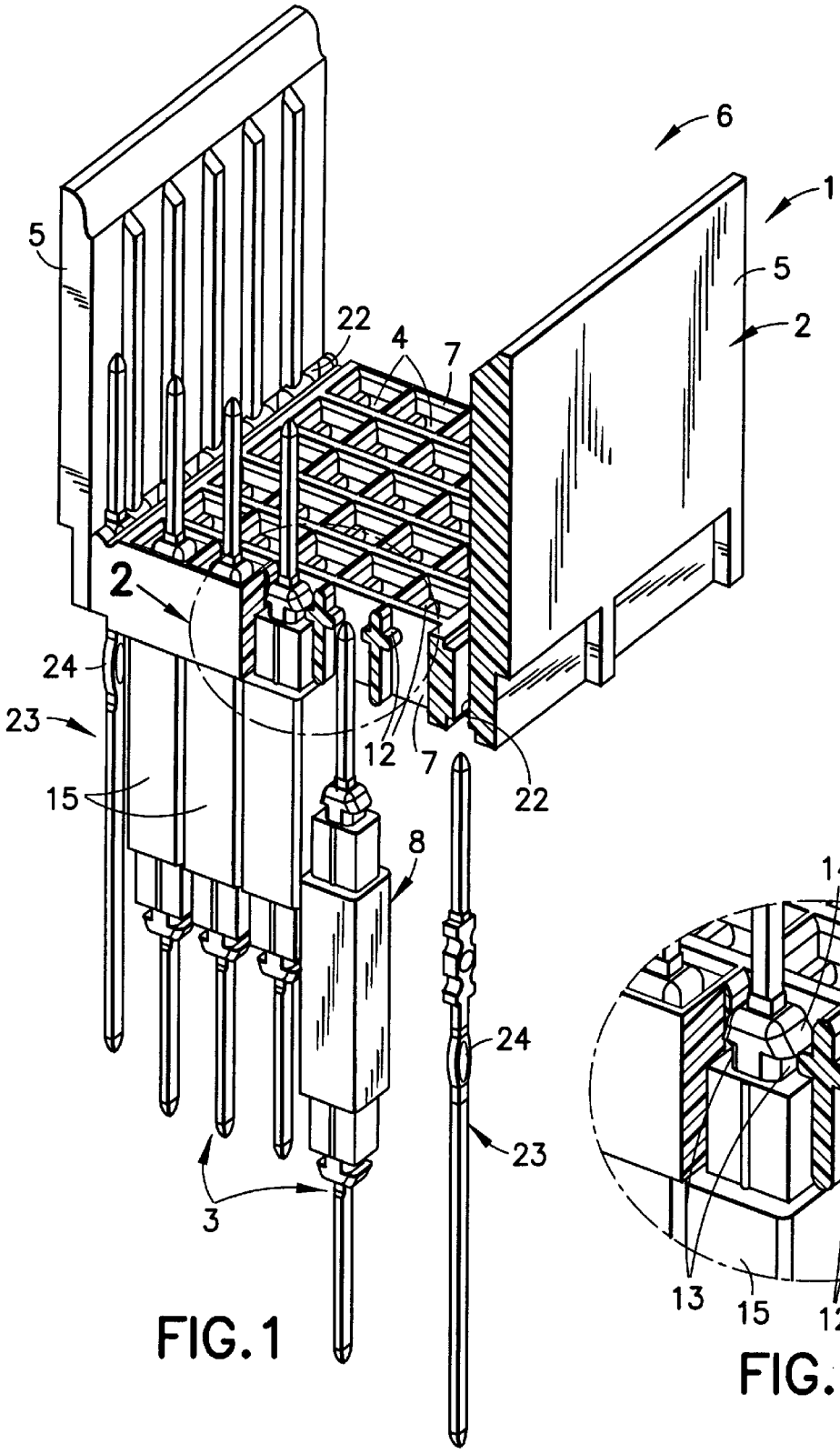
FIG. 1 shows a perspective view of an embodiment of the connector of the invention.

FIG. 1 shows a connector 1, in particular a connector for high frequency signals. The connector 1 comprises a housing 2 of insulating material and a number of male contact elements 3 arranged in rows and columns in a usual manner. For the sake of clarity only some of the contact elements 3 are shown in FIG. 1. The housing is provided with a bottom 4 and two opposite side walls 5 extending upwardly from the bottom 4. The bottom 4 and side walls 5 determine a receiving space 6 for receiving a female connector with female contact elements not further shown.

Figure 2:
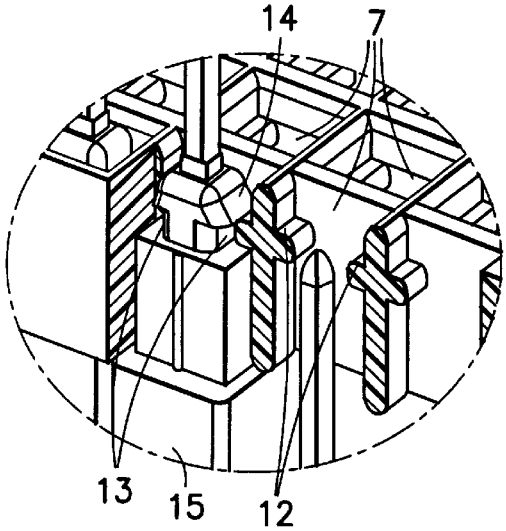
FIG. 2 shows detail II of FIG. 1 at a larger scale.
Figure 3:
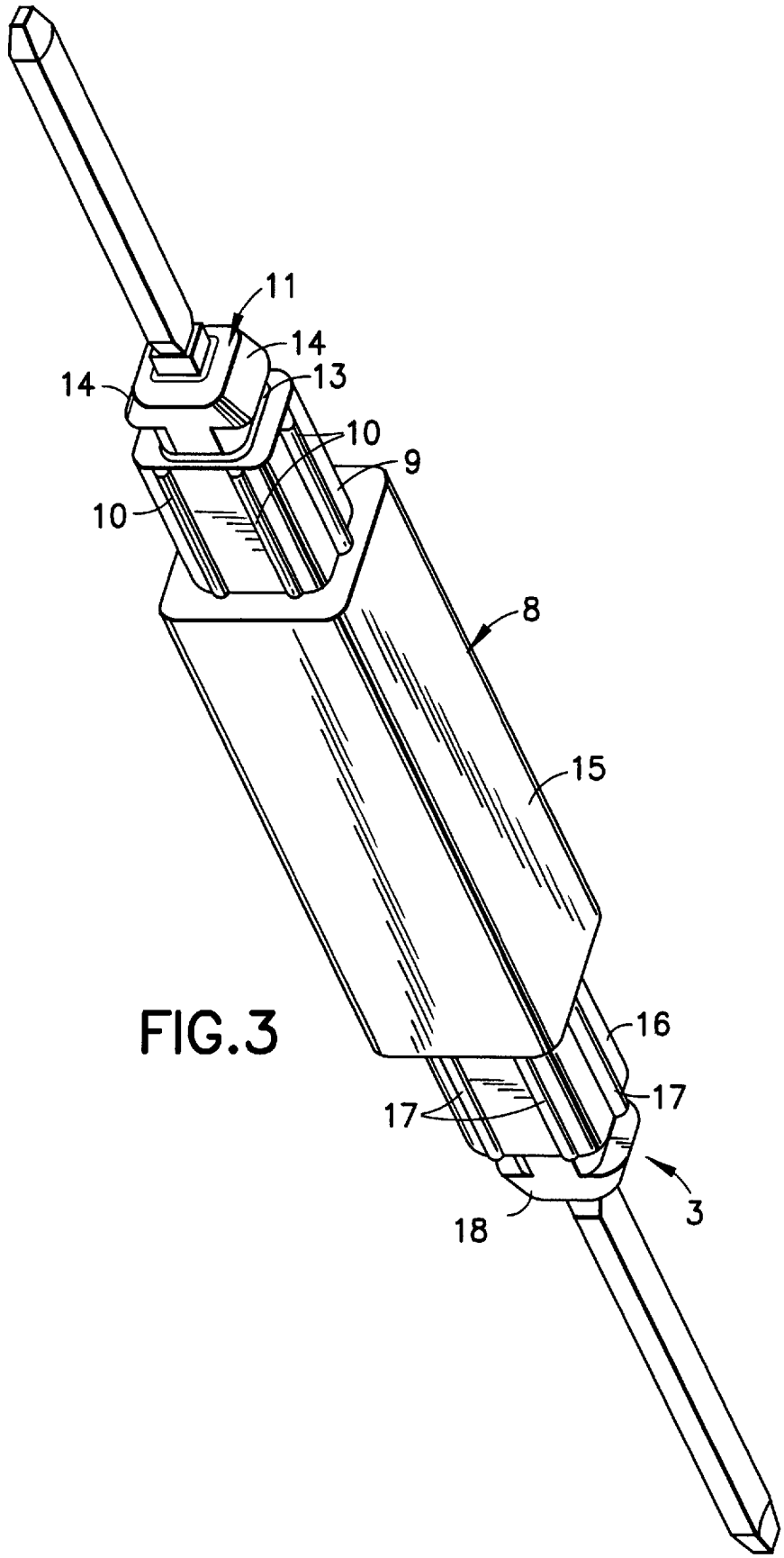
FIG. 3 shows a contact element of the connector of FIG. 1 at a larger scale.

As can be seen in FIG. 1, the bottom 4 is provided with cavities 7 for receiving the contact elements 3 and these cavities 7 are arranged in rows and columns. The cavities 7 are metallized at their inner walls and the contact elements 3 are mounted in the cavities 7 by means of a support element 8 of insulating material. As shown in more detail in FIGS. 2 and 3, each support element comprises a body 9 having an outer dimension which is smaller than the inner dimension of the corresponding cavity 7. Further, the support element 8 comprises a plurality of ledges 10 extending mainly in axial direction of the contact element 3 and determining an outer dimension which is larger than the inner dimension of the corresponding cavity. In this manner a stable mounting and positioning of the contact elements 3 within the housing 2 is guaranteed.

Further the support elements 8 are provided at their upper side with a head part 11 for locking the contact elements 3 in the cavities 7. The inner wall of each metallized cavity 7 is provided with inwardly projecting ledges 12 at opposite sides and these ledges 12 engage into slots 13 at opposite sides of the head part 11. To facilitate mounting of the contact elements 3 in the cavities 7, the head part 11 is provided with oblique faces 14 extending outwardly and downwardly from the contact pin 3 towards said slots 13.

The support elements 8 are further provided with a lower extension 15 surrounding the contact element 3 and at the side opposite the receiving space 6 a further body 16 with ledges 17 is provided just as a further head part 18. The head part 18 is exactly the same as the head part 11. The complete support element 8 from the body 9 and ledges 10 up to the body 16 and ledges 17 is metallized so that the contact element 3 behaves as a coaxial contact element, the metallization being the outer conductor. The ledges 10 provide an interconnection between the metallization of the inner walls of the cavity 7 and the metallization of the support element 8.

Figure 4:
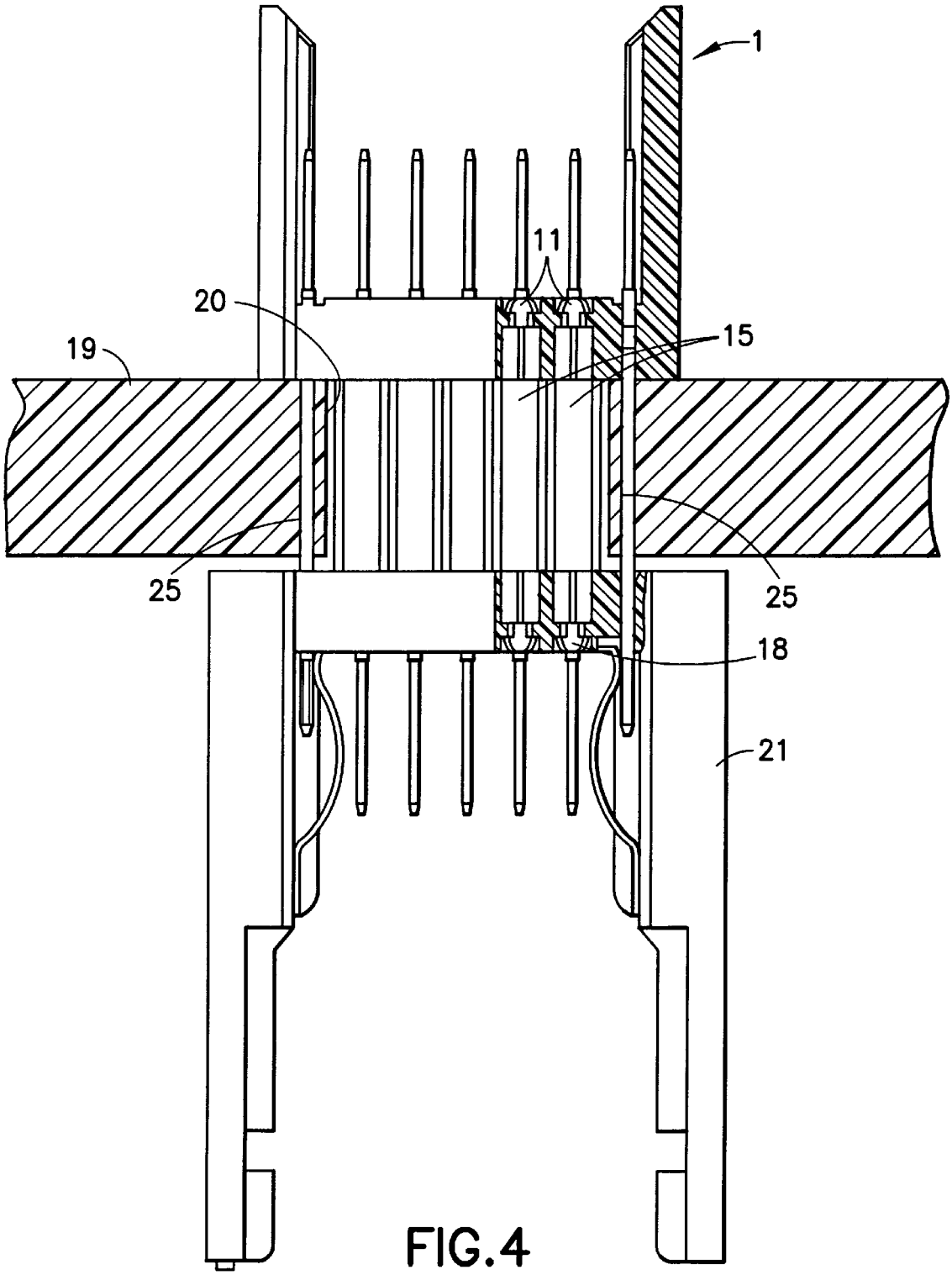
FIG. 4 is a cross section of the connector of FIG. 1 as mounted on a printed circuit board.

The connector 1 described is suitable for mounting on a printed circuit board 19 having a slot 20 for receiving the extensions 15 of the support elements 8. At the side opposite of the housing 2 (lower side in FIG. 4) a housing or shroud 21 can be mounted. The bottom of this housing is provided with cavities 7 in the same manner as the bottom 4 of the housing 2 to receive the head parts 18.

Both outer ends of the contact elements 3 are made as male contact pins for connection to female contact elements not shown.

At both sides of the cavities 7 standard cavities 22 are provided in which standard male contact elements 23 are mounted. As the complete housing 2 is metallized, these cavities 22 are also metallized at their inner walls and this metallization is contacted by the contact elements 23. The contact elements 23 are provided with a press-fit sections 24. These press-fit sections 24 are inserted into plated through holes 25 of the printed circuit board 19. In this manner the connector 1 is mounted and fixed on the printed circuit board 19 and a ground connection with the printed circuit board 19 is thereby obtained.

The connector 1 described shows the advantage that the connector can be adapted to different applications in an easy manner. The same housing 2 can be used with different contact elements 3 with different support elements 8.

The support elements 8 are mounted on the contact elements 3 by overmoulding and a fixation of the support element 8 on the contact element 3 is obtained by providing the contact elements with projections, a thickening or the like.

The invention is not restricted to above described embodiment which can be varied in a number of ways within the scope of the claims.

What is claimed is:

1. An electrical connector for high frequency signals, said connector comprising: a housing of insulating material and a plurality of male contact elements, said housing having a bottom and two opposite side walls extending upwardly from the bottom, the bottom and side walls determining a receiving space, wherein the bottom is provided with cavities having inner walls and arranged in rows and columns, wherein each of the contact elements is mounted in one of said cavities, an upper end of each contact element projecting into the receiving space, at least a plurality of said cavities being metallized at their inner walls, each of the contact elements being positioned in an insulative support element and said support elements being mounted in the metallized cavities, wherein each of said support elements has an upper portion having an outer surface and a lower extension portion directed away from the receiving space, said outer surface being metallized, and wherein the inner wall of each cavity and the support element of the corresponding contact element are provided with cooperating latching means for locking the support element and the contact element in the cavity.

2. The electrical connector according to claim 1, wherein each support element comprises a body having said upper portion with an outer dimension which is smaller than the inner dimension of the corresponding cavity, and a plurality of ledges extending mainly in an axial direction of the contact element and determining an outer dimension which is larger than the inner dimension of the corresponding cavity to cause a force fit between said ledges and said body.

3. The electrical connector according to claim 1, wherein the inner wall of each metallized cavity is provided with two opposite protruding ledges and each corresponding support element is provided with a head part having slots at opposite sides for receiving the ledges.

4. The electrical connector according to claim 3, wherein each support element is provided at both axial ends with a head part having slots at opposite sides for engageably receiving the protruding ledges of a cavity.

5. The electrical connector according to claim 3, wherein each head part is provided with oblique faces extending outwardly and downwardly from the contact pin towards said slots.

6. The electrical connector according to claim 1, wherein each support element is fixed to the corresponding contact element, preferably by overmoulding.

7. The electrical connector according to claim 1, wherein the housing is completely metallized.

8. The electrical connector according to claim 1, wherein a row of cavities is provided adjacent each of the sidewalls and adjacent one of the rows of metallize cavities, wherein male ground contact elements are mounted in the cavities of these rows, said ground contact elements contacting the metallization in the corresponding cavities and having terminals electrically in common therewith for connection to a printed circuit board.

9. The electrical connector according to claim 8, wherein said terminals of the ground contact elements are made as pressfit terminals.

* * * * *